US006788256B2

(12) United States Patent
Hollister

(10) Patent No.: US 6,788,256 B2
(45) Date of Patent: Sep. 7, 2004

(54) CONCEALED ANTENNA ASSEMBLY

(75) Inventor: John E. Hollister, Houston, TX (US)

(73) Assignee: Cingular Wireless, LLC, Atlanta, GA (US)

( * ) Notice: Subject to any disclaimer, the term of this patent is extended or adjusted under 35 U.S.C. 154(b) by 71 days.

(21) Appl. No.: 10/251,222

(22) Filed: Sep. 19, 2002

(65) Prior Publication Data

US 2004/0056802 A1 Mar. 25, 2004

(51) Int. Cl.[7] ..... H01Q 1/38
(52) U.S. Cl. ..... 343/700 MS; 343/878; 343/892
(58) Field of Search ..... 343/700 MS, 878, 343/890, 892

(56) References Cited

U.S. PATENT DOCUMENTS 5,621,571 A * 4/1997 Bantli et al. ..... 359/529
6,457,270 B1 * 10/2002 Stark et al. ..... 40/570
D474,509 S * 5/2003 Kim, II ..... D20/42

* cited by examiner

*Primary Examiner*—Shih-Chao Chen
(74) *Attorney, Agent, or Firm*—Coulter C. Henry, Jr.

(57) ABSTRACT

A concealed antenna assembly includes a base aligned with and attached to a ceiling, a planar sign having a transparent front and back face and an interior surface, a planar antenna concealed within the planar sign, and a light source for illuminating the sign. The sign is disposed substantially perpendicular to and beneath the base. The interior surface of the sign defines a channel extending within the sign in which a planar microstrip antenna is concealed. The antenna has a front and back face and a radio frequency connection point. The front or back face of the antenna has lettering visible through the front or back face of the sign. A surface area of the front or back face of the antenna is equal to or less than a surface area of the front or back face of the sign.

20 Claims, 6 Drawing Sheets

CONCEALED ANTENNA ASSEMBLY

DESCRIPTION OF THE INVENTION

1. Field of the Invention

The present invention relates to an antenna for use in a wireless communications system. More particularly, the present invention relates to an antenna aesthetically concealed in a sign particularly suited for use in indoor wireless applications.

2. Background of the Invention

In a wireless communications system, such as a cellular telephone system, a network of antennas and radios is typically designed to provide uniform coverage throughout a given service area. A wireless communications provider strives to enable communications at any point over the service area. Since a wireless service area often includes buildings, it is desirable to provide wireless service to customers inside buildings. Unfortunately, indoor wireless coverage is often difficult to maintain. Typically, the quality of indoor coverage is related to the proximity of an outdoor cellular site. For example, a building located adjacent to an outdoor cellular communications site would receive adequate coverage, while a building situated farther away from that site would not. Increasingly, designers are incorporating antennas and radios within buildings to provide indoor coverage. These antennas and radios operate as miniature wireless communications sites within a building.

In order to obtain adequate coverage within a building, it is often necessary to distribute antennas throughout the building. For example, in a multi-story building, it would be necessary to place antennas at strategic locations on every floor in order to obtain sufficient coverage. Unfortunately, antennas for indoor wireless communications are often bulky and unsightly. While it is desirable from a communications standpoint to distribute numerous antennas throughout a building, an architect or building designer may wish to limit the number of antennas for aesthetic purposes.

Currently, numerous antenna manufacturers make antennas for use in indoor settings. These antennas typically come in two different types—wall mounted and ceiling mounted. For example, the MP8068 series wall-mounted antenna available from Maxrad, Inc. of Hanover Park, Ill. operates at 806 to 960 MHz and occupies a wall surface area of 16.4 inches by 9 inches. The PA002 and PA004 wall-mounted antennas available from Radiall/Larsen of France operate in the 1900 MHz and 850 MHz spectrums, respectively and each occupies a wall surface area of 9.4 inches by 6.75 inches. Likewise, the ASPPD2988 and ASPPK29988 models available from Antenna Specialists of Lorain, Ohio operate at the 850 MHz and 1800 MHz bandwidths, respectively and occupy wall surface areas of 8.5 inches by 8.4 inches and 4.2 inches by 3.9 inches, respectively. The model 7190.01 wall-mounted antenna, available from AlIgon Enterprises of Sweden, operates in the 850 MHz range and occupies a wall surface area of 10.5 inches by 9 inches. In addition, each of these wall-mounted antennas extends out from the wall 1.5 to 3 inches. As is evident, each of these antennas may be unsightly in certain applications, and the placement of these antennas in a building may also be limited. In addition, each of these antennas is a unidirectional antenna. Unidirectional antennas have a transmit and receive area that is located in one direction out from the wall on which the antenna is mounted.

In addition to wall-mounted antennas, many manufacturers make antennas that can be mounted on a ceiling or in a corner. For example, Decibel Products of Dallas, Tex. offers the model DB791 S50N, which operates at 824 MHz to 960 MHz and can be mounted below the ceiling in a corner. This antenna occupies an area of 6.1 inches by 6.1 inches by 6.1 inches. Decibel Products also manufactures an omni-directional ceiling-mount antenna for use in the 850 MHz bandwidth that occupies an area of 4 cubic inches (Decibel Products model number DB784SM5N). In addition, the Decibel Products model number DB781S50N ceiling-mounted bidirectional antenna for use in the 850 MHz spectrum occupies an area of 1 cubic foot. The MPA806 ceiling-mount antenna, available from Antel International of Rockford, Ill., is an omni-directional antenna housed in an elliptical covering with a diameter of 8.5 inches and a height of almost 3.5 inches. The Maxrad Inc. ALPC800 antenna is a quarter wavelength stub antenna for the 800 MHz to 960 MHz frequency range that is disguised in a speaker baffle. This antenna extends almost 3 inches down from the ceiling.

There are numerous problems with each of these conventional antennas. Both wall-mounted and ceiling-mounted antennas can be unsightly. Architects and building designers are reluctant to place large antennas such as those listed within an architecturally pleasing space. Further, each of the conventional antennas listed may only be placed in certain areas within a building. For example, a wall-mounted antenna must be placed, of course, on a wall. The location of a wall within a given space may not provide for the proper placement of an antenna to provide sufficient indoor wireless communications coverage. Likewise, ceiling-mounted antennas may also be constrained as to their placement. For example, a ceiling-mounted antenna must be placed below the ceiling plane. It cannot be placed above the ceiling plane because of limited space and the potential for structures that may block its signal.

In addition, many of the ceiling-mounted antennas manufactured today are omni-directional antennas. In general, in the 800 to 1000 MHz frequency range, manufacturers of ceiling-mounted antennas only offer omni-directional antennas. An omni-directional antenna has a transmit and receive area that is concentrically oriented around the antenna. In this manner, the transmit and receive area is bounded by a sphere or toroid around the antenna. In order to obtain sufficient indoor coverage, it is often necessary to use numerous omni-directional ceiling-mounted antennas. For example, an omni-directional ceiling-mounted antenna may have a transmit and receive area encompassing a circle with a diameter of 20 feet. In such a case, in order to obtain sufficient indoor coverage in a large building, it would be necessary to place numerous omni-directional ceiling-mounted antennas evenly throughout the building. This may not be possible because of certain design constraints and also because the number of antennas would be unsightly. In addition, in order to provide sufficient indoor coverage with omni-directional antennas, it may be necessary to place antennas such that their coverage area extends outside the building. This bleed-out of antenna coverage is undesirable and inefficient. When using omni-directional antennas, the designer of an indoor wireless antenna system often faces a tradeoff between indoor coverage and bleed out.

On the other hand, directional antennas provide better coverage while eliminating the bleed-out problem. Directional antennas generally have a transmit and receive pattern that is better suited to indoor design. Further, fewer directional antennas would be required to cover the same amount of interior space. However, directional antennas tend to be larger than omni-directional antennas. In order to focus the energy in a directional antenna, it is necessary to increase the size of that antenna. For example, a unidirectional antenna or a bi-directional antenna for any given frequency range is typically larger than an omni-directional antenna. A unidirectional antenna has a transmit and receive area that is disposed in one direction from the antenna, while a bidirectional antenna has a transmit and receive area that is disposed in two opposite directions, one from each side of the antenna. In addition, the larger the antenna size, the more efficient the antenna. A larger size antenna has more capability to direct its power in a certain direction. Therefore, the more efficient antennas, and the antennas that would be better suited for providing sufficient indoor coverage, are also the larger more unsightly antennas. For example, a unidirectional or bi-directional patch antenna operating in the 800 to 1000 MHz frequency range would occupy an area of approximately 6 by 6 inches. Likewise, the same antenna operating at 1900 MHz would be about half that size or 3 by 3 inches.

As is commonly known, the size of an antenna is directly proportional to the wavelength of the signal with which it operates. In this manner, the wavelength is proportional to the inverse of the frequency. A signal with a larger wavelength (and a smaller frequency) requires a larger antenna. Conversely, a signal with a smaller wavelength (and a larger frequency) requires a smaller antenna.

Further, it is a challenge to provide indoor coverage because buildings are of different shapes and sizes. For example, many new office buildings are not simply square but often are rectangular or elongated or have sweeping curves. In order to design an 850 MHz antenna system to provide sufficient indoor coverage in an odd-shaped building, it is often necessary to use numerous omni-directional antennas. Since manufacturers typically only make omni-directional antennas for the 850 MHz bandwidth, many of the problems previously described are encountered in designing an antenna system for an odd-shaped building. For example, in order to provide proper coverage, it is necessary to use antennas such that bleed-out occurs outside the building. In addition, due to placement constraints, it may not be possible to provide adequate indoor coverage in an odd-shaped building.

Indoor coverage is also desirable in noisy environments. In general, a wireless communications signal must have a minimum signal strength of 20 decibels (dB) higher than the noise on that particular channel. Many urban areas are congested with different types of communications systems. These different communications systems may provide a noisy environment in which a wireless system operates. Therefore, it is desirable to have antennas disposed throughout a building in order to provide adequate signal strength for wireless communication.

Further, a wireless communications device, such as a cellular phone, may interfere with various equipment. For example, in a hospital, it is often forbidden to use a cellular phone. Many cellular phones interfere with the various electronic devices used in a hospital. In general, a cellular phone has a maximum power output of between 400 and 600 milliWatts (mW). A cellular telephone operates at the power necessary in order to receive a signal from a cellular site. For example, a cellular telephone that is located a far distance from a cellular communications site will operate at its maximum power, 600 mW. Conversely, a cellular telephone located close to a cellular communications site will output a lot less power, for example, 50 mW. This lower power signal is less likely to interfere with electronic equipment in a hospital. In addition, this lower power signal also preserves the battery life of a cellular phone. Therefore, it would be desirable to place numerous antennas throughout a hospital so as to avoid interference with electronic equipment. In addition, it is desirable to place numerous antennas throughout any building to preserve battery life on a wireless device.

SUMMARY OF THE INVENTION

In one aspect consistent with the principles of the present invention, a concealed antenna assembly includes a base aligned with and attached to a ceiling, a sign having two transparent planar pieces disposed substantially parallel to each other, the two planar pieces of substantially the same size and shape, the two planar pieces disposed substantially perpendicular to and beneath the base, the two planar pieces each having a front and back face, the two planar pieces arranged so that their back faces face each other, the back faces at least partially defining a channel, a substantially planar microstrip antenna concealed in the channel, the antenna having a front and back face and a radio frequency connection point, the front or back face of the antenna having lettering visible through at least one of the planar pieces of the sign, wherein a surface area of the front or back face of the antenna is equal to less than a surface area of the front or back face of the planar pieces, and a light source for illuminating the sign.

In another embodiment consistent with the principles of the present invention, a concealed antenna assembly includes a base aligned with and attached to a ceiling, a planar sign having a transparent front and back face and an interior surface, the sign disposed substantially perpendicular to and beneath the base, the interior surface defining a channel extending within the sign, a substantially planar microstrip antenna disposed in the channel, the antenna having a front and back face and a radio frequency connection point, the front or back face of the antenna having lettering visible through the front or back face of the sign, wherein a surface area of the front or back face of the antenna is equal to or less than a surface area of the front or back face of the sign, and a light source for illuminating the sign.

In yet another aspect consistent with the principles of the present invention, a concealed antenna assembly includes a base aligned with and attached to a ceiling, a planar sign having a front and back face, the planar sign having lettering, the planar sign disposed substantially perpendicular to and beneath the base, a substantially planar microstrip antenna having a front and back face and a radio frequency connection point, the antenna disposed on the front or back face of the sign such that the front or back face of the antenna is adjacent to the front or back face of the sign, wherein a surface area of the front or back face of the antenna is equal or less than a surface area of the front or back face of the sign, and a light sources for illuminating the sign.

Additional advantages of the invention will be set forth in part in the description which follows, and in part will be obvious from the description, or may be learned by practice of the invention. The advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention.

DESCRIPTION OF THE EMBODIMENTS

Reference will now be made in detail to the exemplary embodiments of the invention, examples of which are illustrated in the accompanying drawings. Wherever possible, the same reference numbers will be used throughout the drawings to refer to the same or like parts.

Consistent with the general principles of the present invention, a concealed antenna assembly includes a base, a sign, a substantially planar antenna concealed within the sign, and a light source for illuminating the sign. As herein embodied and illustrated in FIG. 1, a concealed antenna assembly includes a base 110, a sign comprising of planar piece 120 and planar piece 125, and a substantially planar antenna 130 concealed between the two planar pieces, 120 and 125.

Figure 1:
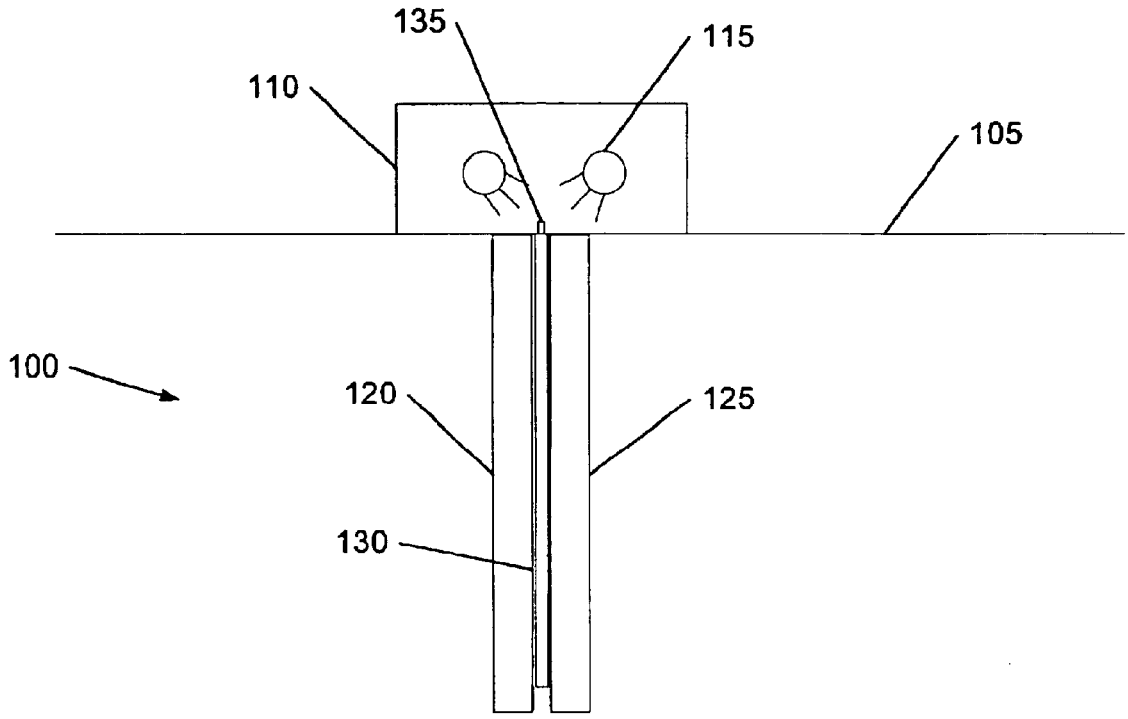
FIG. 1 is a side cutaway view of a concealed antenna assembly consistent with the principles of the present invention.

In the exemplary embodiment of FIG. 1, base 110 is disposed above ceiling 105. The base 110 is aligned with and attached to ceiling 105. The base 110 houses a light source 115 for illuminating the sign. Two planar pieces, 120 and 125, are disposed substantially parallel to each other and substantially perpendicular to and beneath the base 110. Likewise, the two planar pieces, 120 and 125, are disposed substantially perpendicular to and beneath ceiling 105. A substantially planar antenna 130 is concealed between planar piece 120 and planar piece 125. In this manner, antenna 130 is concealed in a channel or area formed between planar piece 120 and planar piece 125. Planar piece 120 and planar piece 125 are disposed parallel to each other so that an opening or channel is formed between them. This channel can be of any width to accommodate antenna 130. Radio frequency connection 135 extends from planar antenna 130. In this case, radio frequency connection 135 extends above ceiling 105 and into base 110.

The embodiment of FIG. 1 is simplified. Numerous other features of antenna assembly 100 are not depicted in FIG. 1. For example, electronics that may be associated with antenna assembly 100 are not shown in FIG. 1. Cabling attaching antenna 130 via radio frequency connection 135 to other components of a distributed antenna system or indoor microcell is also not shown.

Base 110 typically extends above ceiling 105 and houses various electronic components and, in this case, a light source 115 for illuminating the concealed antenna assembly 100. Base 110 is typically box-like in shape and provides space for the various components that it houses, including light source 115. Base 110, as is commonly known, can be manufactured from metal, plastic, or any other material suitable for housing electronic and electrical components. While the simplified diagram of FIG. 1 depicts base 110 as being disposed above ceiling 105, base 110 may be disposed below ceiling 105. In this alternate embodiment, base 110 may be integrally formed with the two planar pieces, 120 and 125, which form the sign. In a typical installation, however, base 110 is usually concealed above a drop ceiling such as ceiling 105 in a building.

Light source 115, as is commonly known, may be an incandescent or fluorescent light source. Alternatively, light source 115 may be composed of light emitting diodes (LEDs). In the configuration of FIG. 1, light source 115 illuminates planar pieces 120 and 125 and optionally, planar antenna 130.

RF connection 135, as is commonly known, provides an interface between antenna 130 and other communications equipment (not shown). RF connection 135 may be a coaxial connection, CAT connection, or any other convenient type of connection for a cable.

Planar pieces 120 and 125, as well as planar antenna 130 form the visible part of a sign. In one embodiment, planar pieces 120 and 125 are not optically opaque. In other words, planar pieces 120 and 125 may be transparent or translucent. In such a case, lettering may reside on either one or both faces of planar antenna 130. The lettering on planar antenna 130 is then visible through planar pieces 120 and 125. As in a typical edge-lit exit sign, two transparent planar pieces are disposed on either side of a sign containing exit lettering.

In this configuration, planar pieces 120 and 125 may be acrylic, plastic, glass, or any other transparent or translucent material. In addition, planar antenna 130 may be opaque, translucent, transparent, reflective, or it may possess any other optical characteristics desirable for a sign. For example, the concealed antenna assembly 100 may take the form of an edge-lit exit sign such as that manufactured by and available from Lithonia Lighting of Conyers, Ga. In a typical edge-lit exit sign, such as that manufactured by and available from Lithonia Lighting, light source 115 is comprised of light emitting diodes, planar pieces 120 and 125 are formed out of acrylic, and lettering may be contained on planar antenna 130.

Typically, the size of an edge-lit exit sign is approximately 8 inches by 13 inches. In the embodiment depicted in FIG. 1, the size of planar pieces 120 and 125 could be approximately the same size. Planar antenna 130, in this configuration, would then be slightly less than 8 inches by 13 inches so that it can be concealed between planar pieces 120 and 125. In an alternate embodiment, planar pieces 120 and 125 may be opaque. In such a case, planar pieces 120 and 125 may contain lettering for a sign. For example, the exit lettering for an edge-lit exit sign may be contained within planar pieces 120 and 125. Alternatively, the sign lettering may be contained on a front face of planar pieces 120 and 125. In such a case, planar antenna 130 is concealed between opaque planar pieces 120 and 125.

In general, the style, size, and lettering of planar pieces 120 and 125 and planar antenna 130 can be altered to be aesthetically pleasing. For example, planar antenna 130 may be white with red lettering, clear with red lettering, black with red lettering, white with green lettering, clear with green lettering, black with green lettering, red with white lettering, reflective with red lettering, or reflective with green lettering. Numerous other color combinations are within the scope of the present invention. In this manner, concealed antenna assembly 100 can function and appear like a typical edge-lit exit sign.

In alternate embodiments of the present invention, the concealed antenna assembly 100 may be a sign of any type. For example, the lettering on concealed antenna assembly 100 may be: exit, egress, sortie, ausgang, restroom, toilet, phone, no smoking, hallway, department, room, train, platform, or gate. Numerous other letterings may appear in conjunction with concealed antenna assembly 100. In this manner, concealed antenna assembly 100 may appear as any type of sign that is disposed beneath a ceiling such as ceiling 105.

Figure 7:
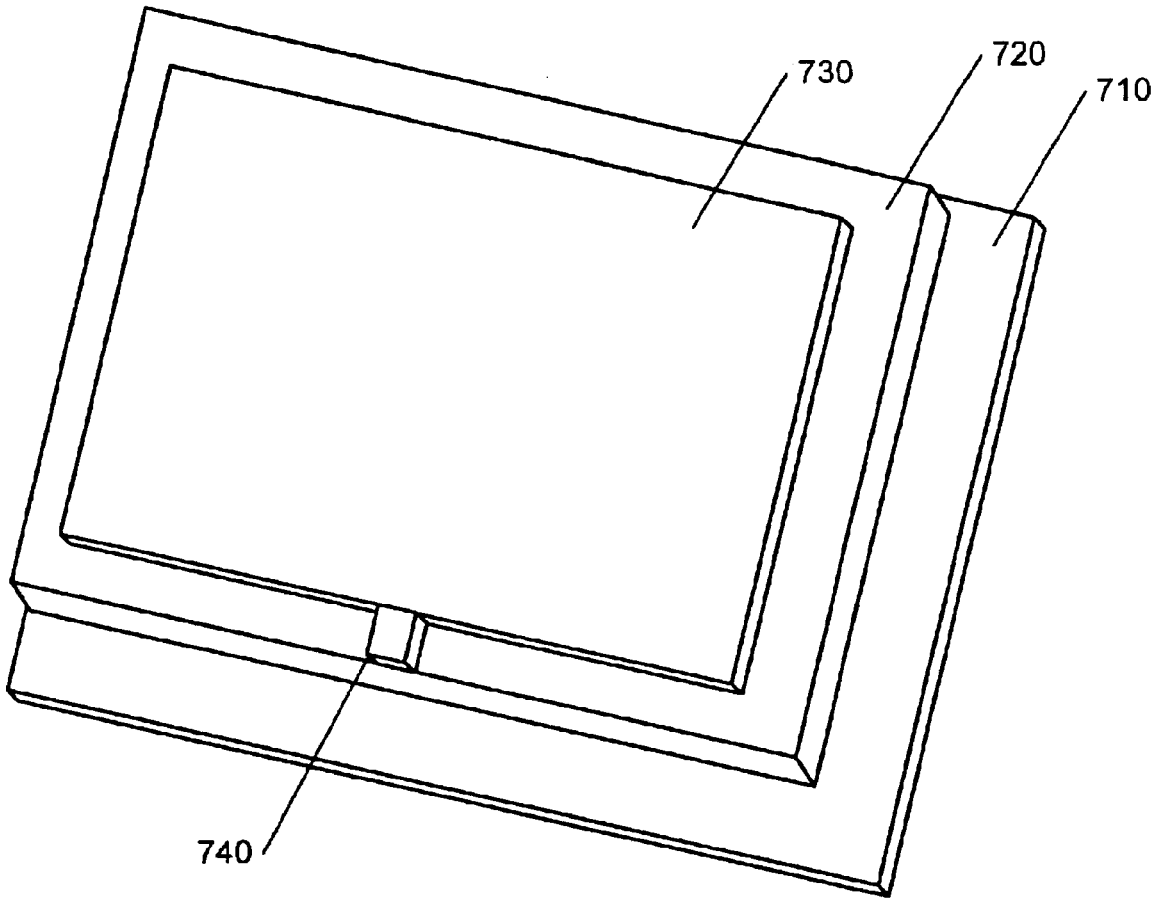
FIG. 7 is a structural diagram of a patch antenna for a concealed antenna assembly consistent with the principles of the present invention.
Figure 8:
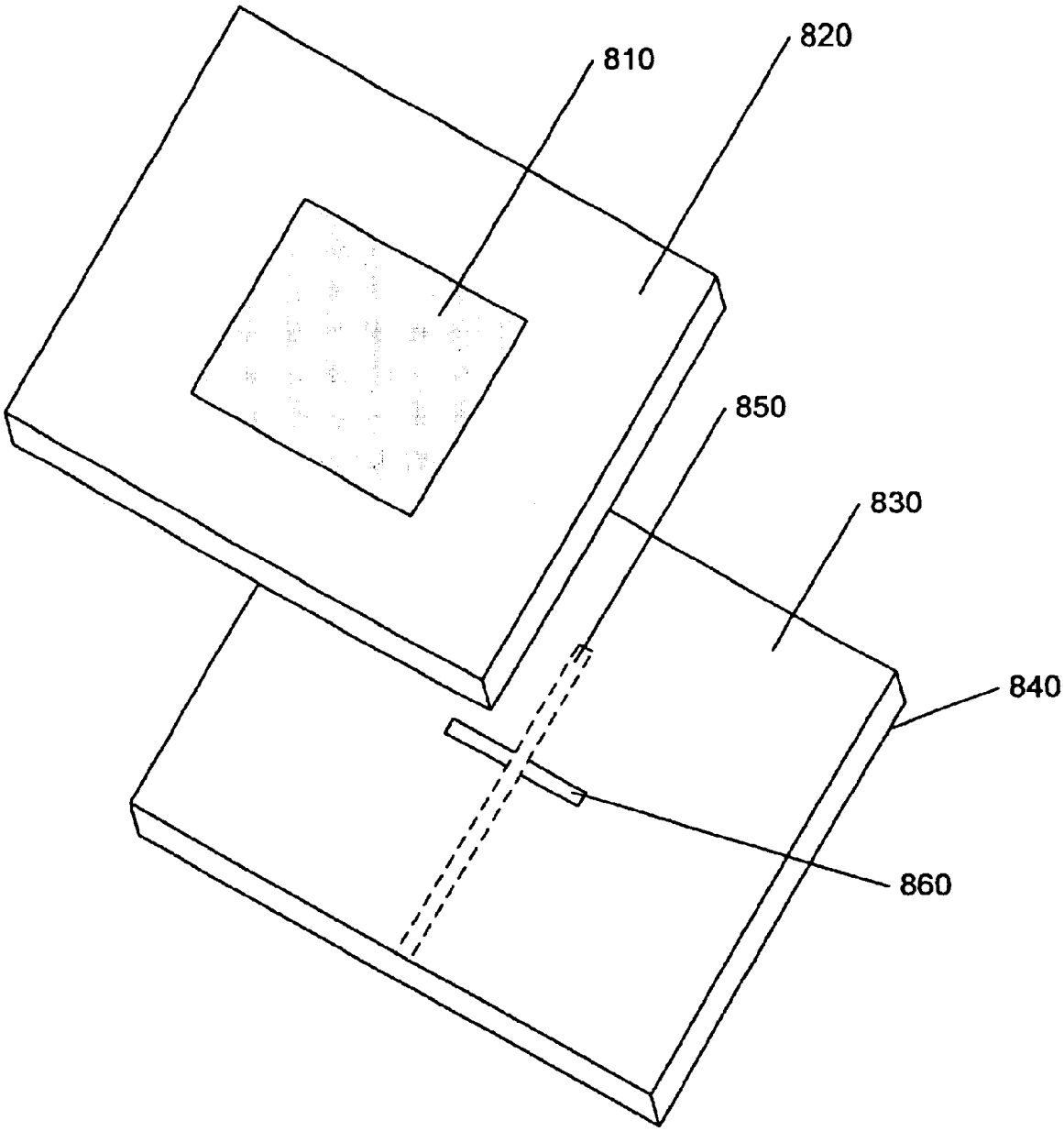
FIG. 8 is a structural diagram of a slot-coupled microstrip antenna for a concealed antenna assembly consistent with the principles of the present invention.

Planar antenna 130 is typically a microstrip or patch antenna. Planar antenna 130 may be a regular patch antenna or a slot-coupled patch antenna. In general, planar antenna 130 may be any type of antenna with a flat profile. In one aspect of the present invention, planar antenna 130 is a bidirectional antenna. In this manner, planar antenna 130 has a transmit and receive area that extends horizontally out from planar pieces 120 and 125. In an alternate embodiment, planar antenna 130 may be a unidirectional antenna. In such a case, the transmit and receive area extends, for example, horizontally out from planar piece 120. While planar antenna 130 may be any type of antenna, it is preferably a bi-directional antenna. Two examples of antennas that can be employed as planar antenna 130 are depicted in FIGS. 7 and 8 and described herein. In general, any type of patch antenna may be used consistent with the principles of the present invention. Patch antennas are commonly known and commercially available.

Planar antenna 130 may operate in the 800 to 1000 MHz frequency range. For example, in a TDMA system, a wireless carrier operates at approximately 850 MHz. In such a case, planar antenna 130 may be a patch antenna operating at 850 MHz that is approximately 6 inches by 6 inches. In general, planar antenna 130 occupies as much area as is required in order to have the desired antenna characteristics. The size of planar antenna 130 is constrained only by the size of planar pieces 120 and 125. Planar antenna 130 has a surface area that is less than that of the planar pieces 120 and 125. In this manner, planar antenna 130 can be concealed completely between planar pieces 120 and 125.

Planar pieces 120 and 125, as well as planar antenna 130, may be of any convenient shape or size. For example, planar pieces 120 and 125 may be of a large size so as to be visible from a great distance. Planar antenna 130, in that case, would then be of a size equal to or less than planar pieces 120 and 125 so that planar antenna 130 may be concealed completely between planar pieces 120 and 125. In addition, planar pieces 120 and 125 may be of any shape. For example, planar pieces 120 and 125 may be elliptical. In such a case, planar antenna 130 may be of any shape and size so as to be concealed between planar pieces 120 and 125. Planar antenna 130, for example, could also be elliptical.

In a further embodiment of the present invention, planar antenna 130 may operate at different frequencies. For example, planar antenna 130 may be a patch antenna that is capable of operating at both 850 MHz and 1900 MHz. In alternate embodiments of the present invention, planar antenna 130 may be a patch antenna that operates at any number of frequencies, such as 800 to 1000 MHz, 1800 to 2000 MHz, and 2.4 GHz. In such a case, a single antenna element may be used for multiple wireless communications systems. For example, an 850 MHz TDMA system may operate in conjunction with a 1900 MHz GSM system, as well as a 2.4 GHz wireless Internet system. In such a case, planar antenna 130 may be a single patch antenna with elements for multiple different systems. In a given service area, a wireless provider may provide TDMA service at 850 MHz, GSM service at 1900 MHz, PCS service at any number of frequencies, and wireless internet service at 2.4 GHz. In such a case, it would be desirable to provide indoor coverage for all these different services with a single antenna. Further, a single patch antenna that is responsive to multiple frequencies can be part of a standard product that can be used in multiple installations. For example, a single concealed antenna assembly may include a single planar antenna 130 that is a patch antenna responsive to multiple different frequencies. In such a case, a contractor can order a single part in the form of an exit sign or other sign that would provide an antenna that is compatible with numerous different systems.

In yet another embodiment of the present invention, base 110 may be mounted to a wall (now shown). In such a case, planar pieces 120 and 125 may be mounted to base 110. Planar pieces 120 and 125 may then extend outward from the base and from the wall. Planar antenna 130, as depicted in FIG. 1, may then be concealed between planar pieces 120 and 125. In other words, the concealed antenna assembly 100 may be mounted to a wall instead of mounted to a ceiling 105.

In a further embodiment of the present invention, planar pieces 120 and 125, as well as planar antenna 130 may be disposed a significant distance below ceiling 105. Optionally, base 110 may also be disposed a significant distance below ceiling 105. For example, in a large atrium, an exit sign may be disposed from a substantial ceiling height. In such a case, the exit sign may be disposed on a rod suspended from the ceiling. In an alternate embodiment, the concealed antenna assembly may be disposed on a beam that is contained within a large atrium. Further, in such an application, the concealed antenna assembly 100 may be disposed on a post. For example, a horizontal post may be disposed within a large room such as an atrium. In such a case, base 110 may be disposed on the post. Planar pieces 120 and 125, as well as planar antenna 130 may then extend outward from the base 110 and the post (not shown). Numerous other configurations are within the scope of the present invention.

Figure 2:
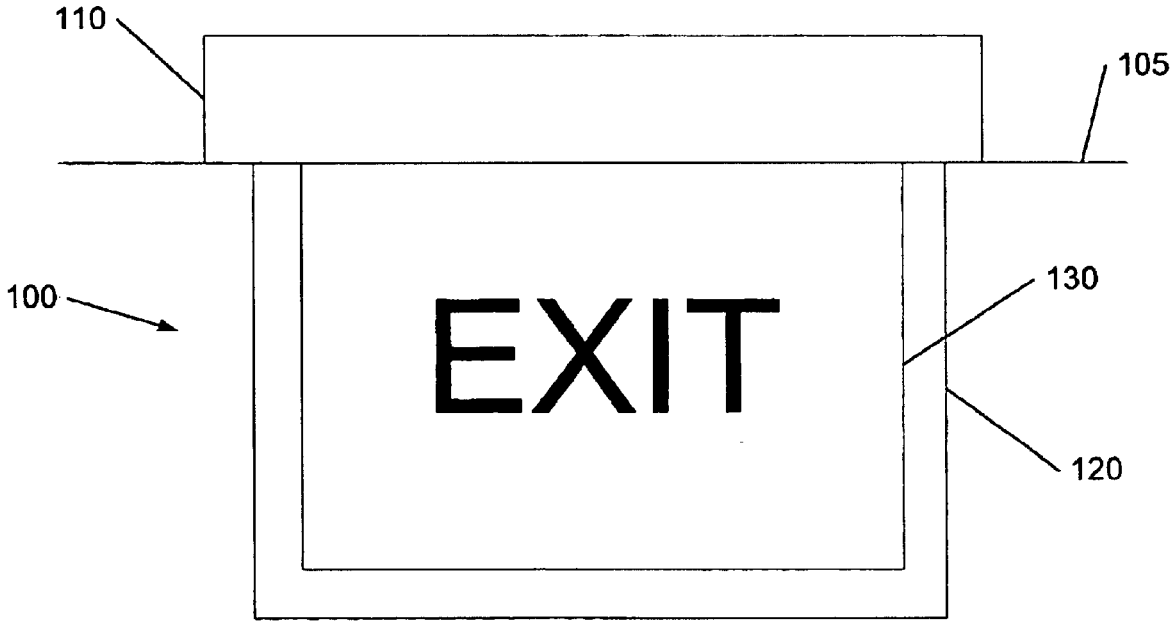
FIG. 2 is a front view of the concealed antenna assembly of FIG. 1.

FIG. 2 is a front view of the concealed antenna assembly of FIG. 1. As can be seen in the exemplary embodiment of FIG. 2, base 110 is disposed above ceiling 105. Planar piece 120 is disposed beneath base 110 and substantially perpendicular to both ceiling 105 and base 110. Planar antenna 130 is disposed behind planar piece 120. In the illustration of FIG. 2, planar piece 125, RF connector 135, and light source 115 are not shown.

In FIG. 2, a concealed antenna assembly is shown as an exit sign. Planar antenna 130 displays exit lettering. Planar piece 120 is translucent or transparent so that the exit lettering on planner antenna 130 is visible.

Figure 3:
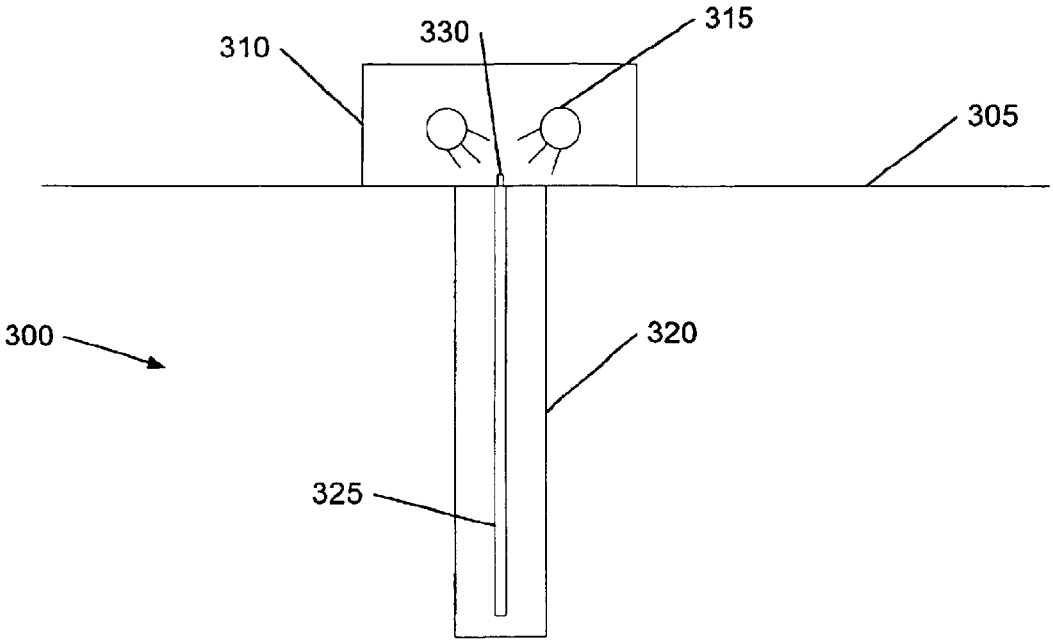
FIG. 3 is a side cutaway view of a concealed antenna assembly consistent with the principles of the present invention.

Referring now to FIG. 3, a concealed antenna assembly 300 includes a base 310, a light source 315, a planar sign 320, and a planar antenna 325. Base 310 is disposed above ceiling 305 and houses light source 315 and RF connection 330. As in the configuration of FIG. 1, sign 320 is disposed perpendicular to and beneath ceiling 305. In the configuration of FIG. 3, planar sign 320 is integrally connected to base 310. A channel is formed within planar sign 320 in which planar antenna 325 may be concealed. The channel contained within sign 320 may be of any width and any depth so as to accommodate planar antenna 325.

The characteristics of concealed antenna assembly 300 are similar to those of concealed antenna assembly 100. The components of concealed antenna assembly 300 possess the same qualities and characteristics of those of concealed antenna assembly 100. For example, sign 320 may be comprised of a translucent, transparent, opaque, or reflective material. As in the case of planar pieces 120 and 125 of concealed antenna assembly 100, sign 320 of concealed antenna assembly 300 may be composed of acrylic so that lettering on planar antenna 325 is visible through sign 320. The configuration of the lettering in concealed antenna assembly 300 is similar to that previously described with reference to FIG. 1. For example, lettering may be contained on planar antenna 325 and sign 320 may be transparent or translucent. Alternatively, sign 320 may be opaque, thereby concealing planar antenna 325. The structural difference between concealed antenna assembly 100 of FIG. 1 and concealed antenna assembly 300 of FIG. 3 is that concealed antenna assembly 100 of FIG. 1 has two planar pieces 120 and 125 while concealed antenna assembly 300 of FIG. 3 has a single sign 320. In FIG. 1, planar pieces 120 and 125 form a channel that conceals planar antenna 130. In FIG. 3, sign 320 has contained within it a channel that conceals planar antenna 325. Other than this structural difference, the concealed antenna assembly 100 of FIG. 1 and the concealed antenna assembly 300 of FIG. 3 possess the same qualities and characteristics.

Figure 4:
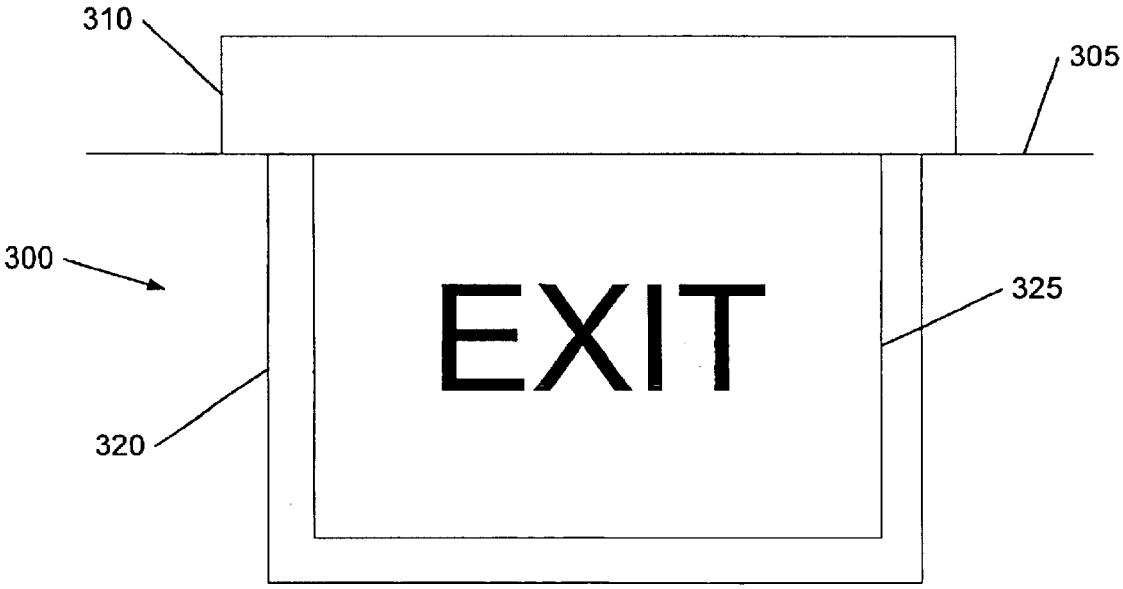
FIG. 4 is a front view of the concealed antenna assembly of FIG. 3.

FIG. 4 is a front view of the concealed antenna assembly of FIG. 3. In the exemplary embodiment of FIG. 4, base 310 is disposed above ceiling 305. Sign 320 is disposed perpendicular to and beneath base 310 as well as ceiling 305. Planar antenna 325 is concealed within sign 320. In the concealed antenna assembly 300 of FIG. 4, sign 320 is transparent or translucent. Planar antenna 325 has exit lettering that is visible through sign 320.

As in the configuration of FIGS. 1 and 2, the concealed antenna assembly 300 of FIGS. 3 and 4 can be of any shape or size. For example, sign 320 may be elliptical in shape and of any convenient size. In such a case, planar antenna 325 may then be of any convenient shape or size to fit within the channel formed within sign 320. The configurations described with respect to FIGS. 1 and 3 are equally applicable to the embodiment depicted in FIGS. 3 and 4.

Figure 5:
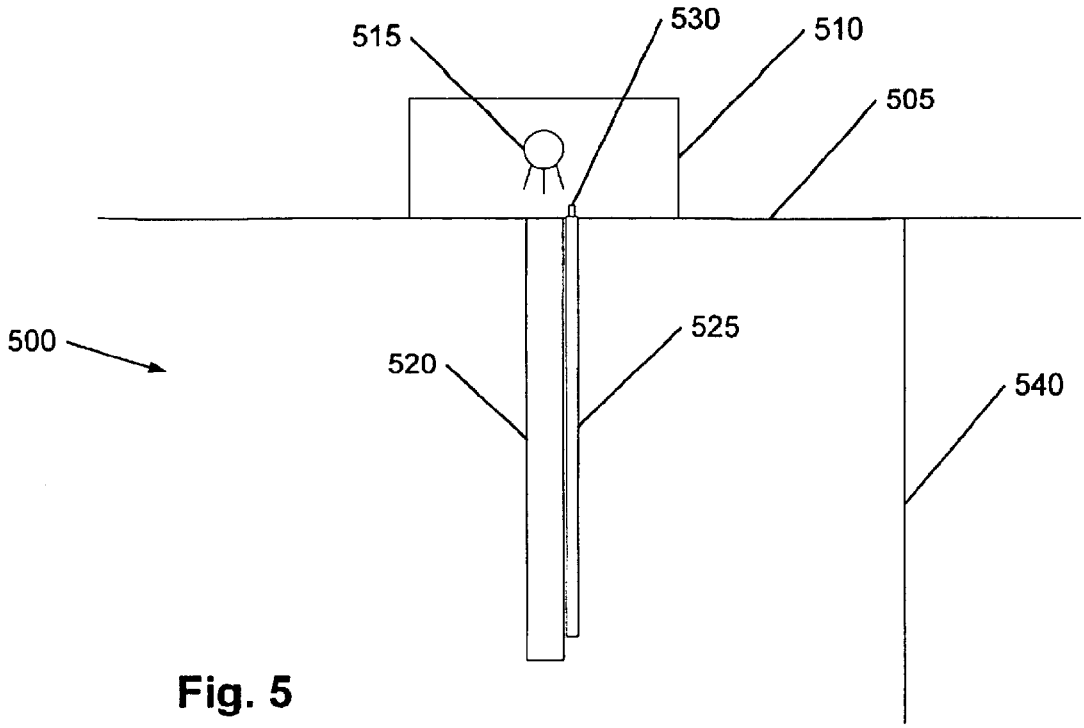
FIG. 5 is a side cutaway view of a concealed antenna assembly consistent with the principles of the present invention.

Referring now to FIG. 5, a concealed antenna assembly includes a base aligned with and attached to ceiling, a planar sign having a front and back face and disposed substantially perpendicular to and beneath the base, a substantially planar microstrip or patch antenna concealed behind the planar sign, and a light source for illuminating the sign.

In the exemplary embodiment of FIG. 5, base 510 is disposed above ceiling 505. In this case, base 510 is attached to ceiling 505. Base 510 houses lighting source 515. Planar sign 520 is disposed perpendicular to and beneath ceiling 505 and base 510. Planar antenna 525 is disposed perpendicular to and beneath base 510 and ceiling 505. Planar antenna 525 is concealed behind planar sign 520.

In one embodiment of the present invention, planar sign 520 may be transparent or translucent. In such a case, planar antenna 525 may contain lettering that is visible through planar sign 520. In another embodiment, planar sign 520 may be opaque, thereby concealing planar antenna 525. In such a case, planar sign 520 may have lettering on it.

The same qualities and characteristics of the components described with reference to FIGS. 1 and 2 is equally applicable to the embodiments of FIGS. 5 and 6. For example, planar sign 520 and planar pieces 120 and 125 may possess the same characteristics. Planar sign 520, like planar pieces 120 and 125, may be transparent, translucent, or opaque. Planar sign 520, like planar pieces 120 and 125, may be made, for example, of acrylic. In addition, planar antenna 130 and planar antenna 525 may possess the same characteristics and qualities. For example, planar antenna 525, like planar antenna 130, may be transparent or translucent. Alternatively, planar antenna 525 may be opaque and of any color. In such a case, planar antenna 525 may contain lettering that is visible through planar sign 520.

Figure 6:
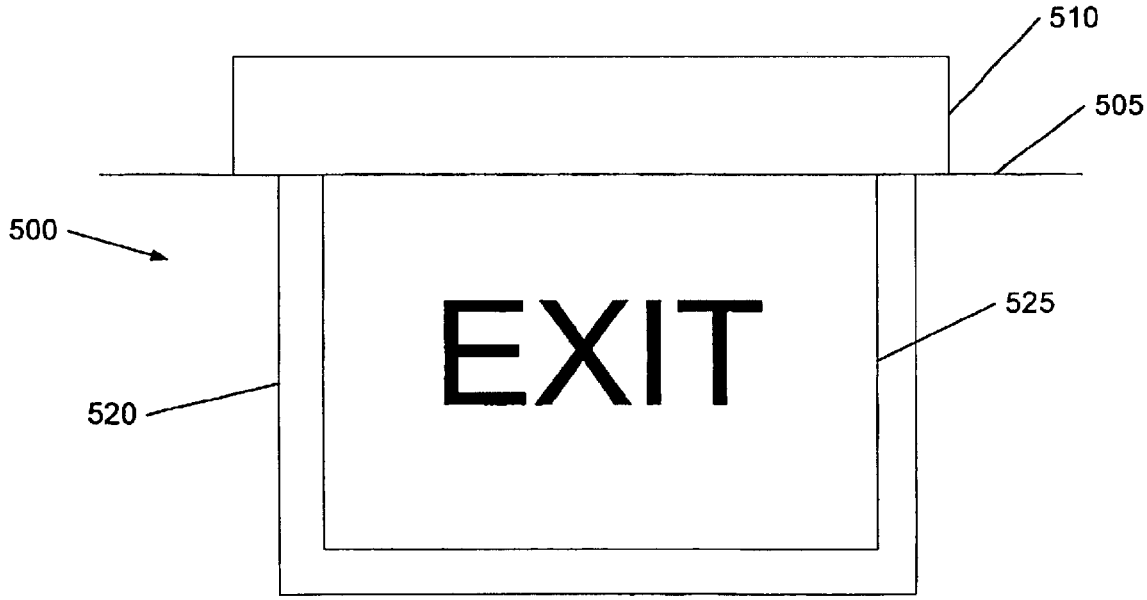
FIG. 6 is a front view of the concealed antenna assembly of FIG. 5.

FIG. 6 is a front view of the concealed antenna assembly depicted in FIG. 5. In the exemplary embodiment of FIG. 6, base 510 is disposed above ceiling 505. Planar sign 520 is disposed perpendicular to and beneath base 510 and ceiling 505. Planar antenna 525 is concealed behind planar sign 520. The difference between the embodiment depicted in FIGS. 1 and 2 and the embodiment depicted in FIGS. 5 and 6 is that in FIGS. 1 and 2, concealed antenna assembly 100 includes two planar pieces 120 and 125, while the concealed antenna assembly 500 of FIGS. 5 and 6 includes a single planar sign 520. The planar sign 520 may possess the same qualities and characteristics of the planar pieces 120 and 125 described with reference to FIGS. 1 and 2.

While concealed antenna assembly 100 of FIGS. 1 and 2 and concealed antenna assembly 300 of FIGS. 3 and 4 may be used in any location on a ceiling, concealed antenna assembly 500 of FIGS. 5 and 6 is generally used near a wall 540. In such an application, it is only necessary to have lettering on one side of the sign. For example, the concealed antenna assembly 500 of FIGS. 5 and 6 may be disposed on a ceiling that is adjacent to a wall 540. In this manner, the wall 540 partially conceals planar antenna 525. In such an application, planar antenna 525 is concealed between planar sign 520 and wall 540.

The concealed antenna assemblies, 100, 300, and 500, may be disposed at any point within a building. In such a case, each of the concealed antenna assemblies would be connected via their respective RF connection points either to a radio or to a distributed antenna system. In one implementation, indoor microcells may directly feed each antenna of the concealed antenna assemblies. In an indoor microcell, a radio is disposed close to the antenna of the concealed antenna assembly. In such a case, the planar antennas of the concealed antenna assemblies, via their RF connection points, are cabled to a radio. In a typical indoor microcell configuration, each antenna in a concealed antenna assembly has associated with it a single radio.

Alternatively, in a distributed antenna system, each antenna is connected to a device that converts a radio frequency signal into a light signal. The light signal is then transmitted over optical fibers to a central unit that converts the light signal back into a radio frequency signal for transmission. In a typical distributed antenna system, each antenna has associated with it a single device that converts a radio frequency signal into a light signal. This device is then connected via an optical fiber cable to a central unit. This central unit contains a device that converts the light signal back into a radio frequency signal, as well as a radio to transmit the radio frequency signal. Therefore, in a typical distributed antenna system, each antenna in a concealed antenna assembly has a device that converts a radio frequency signal into a light signal in close proximity to the antenna. Optical fiber cable is then run from this device, which is close to each antenna, back to a central transmitting unit.

While the concealed antenna assemblies of FIGS. 1 through 6 are described with reference to a wireless communications system such as a cellular telephone or paging system, the concealed antenna assemblies may be used in any number of applications. Since the planar antenna can be configured to be compatible with any number of different frequencies, any number of different communications systems may operate in conjunction with the concealed antenna assembly of the present invention.

Referring now to FIG. 7, a typical microstrip or patch antenna is depicted. This typical patch antenna can be used consistent with the principles of the present invention.

The typical patch antenna 700 of FIG. 7 includes a ground plane 710 and a microstrip element 730 that are located parallel to one another and between which is a dielectric material or substrate 720. Also included in the typical microstrip or patch antenna is a transmission line 740 that provides a communication path for radio frequency signals to and from the microstrip element 730 and the ground plane 710. To transmit RF signals using the microstrip antenna, an RF signal is applied by a transmitter to the transmission line 740 that, in turn, applies the RF signal to the microstrip or patch element 730 and the ground plane 710. In response, an electromagnetic signal is radiated between the edges of the microstrip element or patch 730 and the ground plane 710, in a pattern and at a frequency that is dependent upon, among other things, the positional and dimensional characteristics of the microstrip element or patch 730, the ground plane 710, and the dielectric or substrate 720. Conversely, during reception, the microstrip element or patch 730 and the ground plan 710 resonate upon interacting with an electromagnetic signal of an appropriate frequency to produce an RF signal that is provided by the transmission line 740 to a receiver for decoding.

A microstrip or patch antenna in its simplest form consists of a sandwich of two parallel conducting layers, patch or microstrip element 730, and ground plane 710, separated by a single thin dielectric substrate 720. The lower conductor functions as a ground plane 710, and the upper conductor may be a simple resonant rectangular or circular patch, a resonant dipole, or a monolithically printed array of patches or dipoles and an associated feed network. In the embodiment of FIG. 7, the microstrip or patch element 730 is depicted as a rectangular conductor. Microstrip or patch element 730 may be of any shape or size. Further, feed line 740 may be disposed at any point extending from patch or microstrip element 730.

Ground plane 710 and patch 730, as well as feed line 740, may be made of any type of metal. For example, ground plane 710, as well as patch or microstrip element 730 may be copper.

There are numerous substrate materials on the market today with which to implement substrate 720. For example, polytetrafluoroethylene (PTFE) substrates reinforced with either glass woven web or glass random fiber are commonly used because of their desirable electrical and mechanical properties, and because of the wide range of available thicknesses and sheet sizes. In order to obtain the necessary mechanical properties of PTFE, fill materials are commonly introduced into the polymer matrix. This fill material is commonly glass fiber, although it may also be a ceramic. While the material most frequently used for the substrate 720 of a printed antenna element is PTFE, there are other materials used for specialized applications. For example, substrate 720 may be composed of unreinforced PTFE, glass woven web PTFE, glass random fiber PTFE, quartz reinforced PTFE, cross-linked polystyrene with woven quartz, ceramic powder field cross-linked polystyrene, glass reinforced cross-linked polystyrene, irradiated polyolefin, glass reinforced radiated polyolefin, polyphenylene oxide, or ceramic powder filled silicone resion.

The patch or microstrip antenna of FIG. 7 is commonly known and used in numerous different applications. While a specific configuration is described in FIG. 7, a patch or microstrip antenna of any type may be used in conjunction with the concealed antenna assembly of the present invention.

FIG. 8 depicts a basic aperture or slot-coupled microstrip antenna. In the typical slot-coupled patch antenna of FIG. 8, a microstrip patch 810 is disposed on a substrate 820. A coupling aperture 860, as well as a microstrip feed line 850 is disposed on a ground plane 830. Ground plane 830 is disposed on a feed substrate 840.

In the geometry of the basic aperture-coupled patch antenna of FIG. 8, the radiating microstrip patch element 810 is etched on top of the antenna substrate 820, and the microstrip feed line is etched on the bottom of the feed substrate 840. The thickness and dielectric constants of these two substrates may thus be chosen independently to optimize the distinct electrical functions of radiation and circuitry. The basic aperture-coupled microstrip antenna of FIG. 8 may be modified in a large number of geometric variations. For example, the microstrip patch 810 may be a single rectangular patch. In alternate embodiments, microstrip patch 810 may be a circular patch, a stacked patch, a parasitically coupled array of patches, an array of patches with loading slots, or radiating element consisting of multiple thin printed dipoles. Just as in the patch antenna of FIG. 7, patch 730, as well as microstrip patch 810, may be of any convenient shape or size.

In the slot-coupled patch antenna of FIG. 8, the shape of the coupling aperture 860 impacts the strength of coupling between the feed line 850 and the patch 810. Thin rectangular coupling slots have been used in a majority of aperture-coupled microstrip antennas. Further, coupling aperture 860 may be a round aperture or may have different shapes, such as a dog bone, bow tie, or H shape.

The microstrip feed line 850 can be replaced with other planar lines, such as a strip line, a co-planar wave-guide, or a dielectric wave-guide. The coupling level may be reduced with such lines, however. It is also possible to invert the feed substrate 840, inserting an addition dielectric layer (not shown) so that the feed line 850 is between the ground plane 830 and the patch element 810.

The slot-coupled microstrip antenna may also have any number of polarizations, such as a linear polarization, dual polarization, or circular polarization.

Substrate 840 of the slot-coupled microstrip antenna of FIG. 8 may be configured in any number of ways. As with other types of microstrip antennas, it is easy to add a radome layer (not shown) to an aperture-coupled antenna, either directly over the radiating elements, or spaced above the element. It is also possible to form the antenna and feed substrates from multiple layers, such as foam with thin dielectric skins for the etched conductors.

Examples of aperture-coupled microstrip antennas include a wide band aperture-coupled microstrip antenna and a dual and circularly polarized aperture-coupled microstrip antenna. While the slot-coupled patch antenna of FIG. 8 is but one example of the numerous variety of microstrip or patch antennas available, any number of different microstrip or patch antennas are readily used with the present invention.

The patch antennas of FIGS. 7 and 8 are merely examples of commonly known and commonly used patch antennas. Preferably, the planar antenna of the concealed antenna assembly of the present invention is a bidirectional patch antenna.

Figure 9:
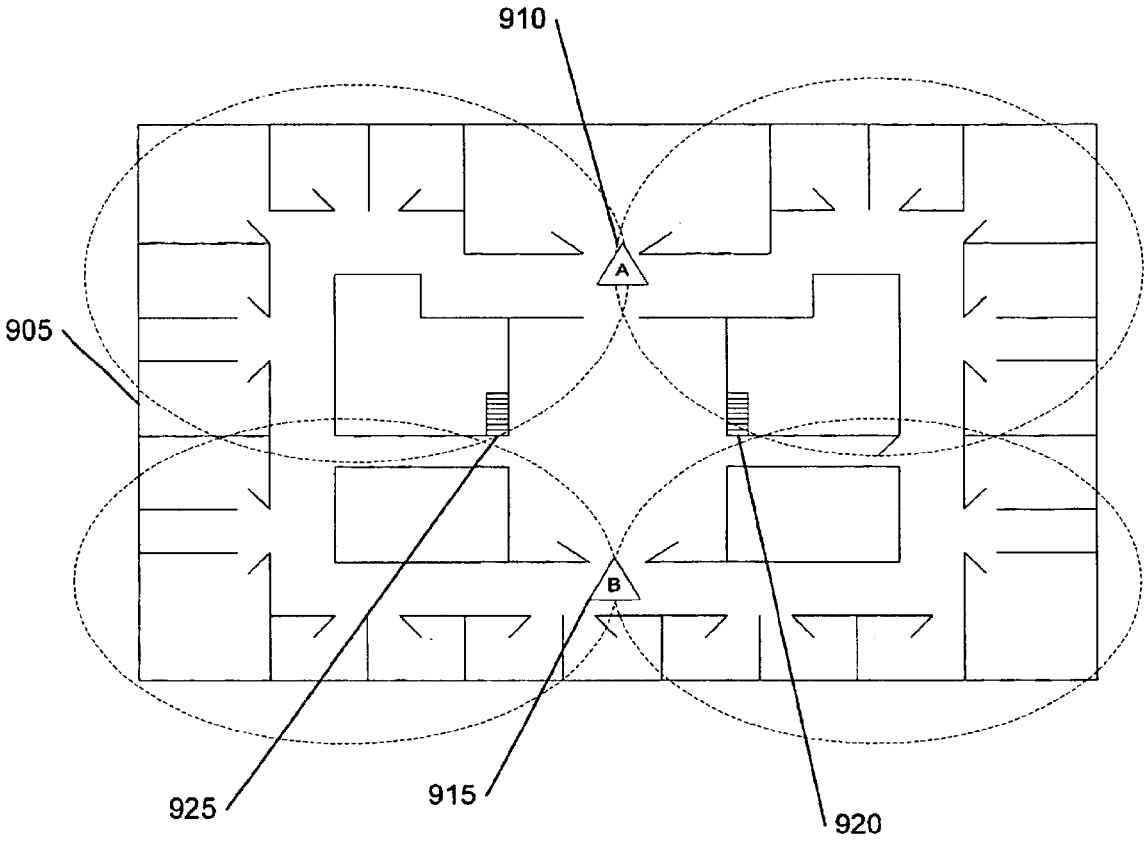
FIG. 9 is a diagram of a building employing a concealed antenna assembly configuration consistent with the principles of the present invention.

FIG. 9 is a plan view of a building using a concealed antenna assembly consistent with the principles of the present invention. FIG. 9 depicts merely one of numerous possible uses of the concealed antenna assembly of the present invention. In the plan diagram of FIG. 9, a building 905 has two exit stairways, 920 and 925. Two concealed antenna assemblies, 910 and 915, are used to provide indoor coverage in building 905. In this case, concealed antenna assemblies, 910 and 915, take the form of exit signs. In this manner, the concealed antenna assemblies, 910 and 915, may be any one of the configurations described in reference to FIGS. 1 through 6. The concealed antenna assemblies, 910 and 915, are those described in FIGS. 1 through 4.

In a typical building, such as building 905, exit signs are necessary to direct people out of the building in case of an emergency. Moreover, exit signs are mandated by building codes. These exit signs, according to regulations, must be placed in particular locations throughout a building. Interestingly, the location of these exit signs would be ideal for the location of indoor antennas. For example, exit signs must be located at various points in a building so as to guide people to the exit stairways 920 and 925. While exit signs would likely be required at numerous locations in the building plan of building 905, two particular exit signs are depicted as concealed antenna assemblies 910 and 915.

Each of the two concealed antenna assemblies, 910 and 915, contain within them a bidirectional patch antenna. This antenna may be a regular patch antenna or a slot-coupled patch antenna as previously described. In this case, the antenna field (or transmit and receive area) is denoted by the dashed elliptical regions radiating from each side of concealed antenna assemblies 910 and 915. For example, concealed antenna assembly 910 has associated with it two elliptical regions which denote the coverage area for the patch antenna contained within concealed antenna assembly 910. Likewise, the two elliptical regions denoted by the dashed lines associated with concealed antenna assembly 915 radiate outward from concealed antenna assembly 915.

In this case, the desirable attributes associated with the antenna placement shown in FIG. 9 are readily evident. First, coverage is obtained throughout the entire floor of building 905 with only two antennas. The placement of these antennas coincides with the typical placement of exit signs in a building. Generally, exit stairways are located in a central area of a building. In this manner, the exit stairways are easily accessible by everyone residing on that floor. Exit signs would then be distributed throughout the building in strategic locations so as to direct people to exit stairways 920 and 925. The locations for these exit signs are often near the center of a building, or in hallways. As is shown in FIG. 9, due to the strategic placement of concealed antenna assemblies 910 and 915, the entire floor of building 905 can be covered with two antennas.

In addition, the use of bi-directional patch antennas in concealed antenna assemblies 910 and 915 translates into a minimum bleed-out outside the building. As can be seen in FIG. 9, the coverage area of the bidirectional patch antennas of concealed antenna assemblies 910 and 915 are contained substantially within the walls of building 905. In this manner, very little of the antenna coverage bleeds outside the walls of building 905, thereby insuring a more efficient power use.

Since only two antennas are needed to cover the floor of building 905, only two sets of associated equipment are necessary. For example, in a distributed antenna system, only two devices that convert radio frequency signals into light signals would be needed on this floor. Likewise, in an indoor microcell configuration, only two radios would need to be disposed on this floor of building 905—one for each antenna contained within concealed antenna assemblies 910 and 915. In this manner, sufficient indoor coverage may be obtained with a minimum amount of antennas and associated equipment, thereby leading to cost savings.

Further, the antenna configuration of FIG. 9 allows for adequate coverage in a noisy environment. As previously mentioned, a transmit signal or signal on which a cellular phone operates, must be at least 20 dBs above the ambient noise. Having two antennas that cover an entire floor allows for an efficient use of radio frequency spectrum. In addition, by disposing concealed antenna assemblies 910 and 915 so that they cover the entire floor of building 905, the battery life of the wireless devices used on that floor can be increased. By disposing antennas close to a wireless device, as previously mentioned, the wireless device does not have to operate at its maximum power. In fact, a typical cellular phone, in the configuration depicted in FIG. 9, will only operate at about 50 mW, as opposed to its maximum of 600 mW. This greatly increases battery life and also results in a decrease in any potential interference with equipment that may be contained within building 905. For example, in a hospital, it is desirable to have wireless devices operate at a minimum power output so as not to interfere with hospital equipment.

In addition, while building 905 is depicted as a regular-shaped, rectangular building, the concealed antenna assembly of the present invention may be used in a building of any shape. By using bidirectional patch antennas in conjunction with concealed antenna assemblies 910 and 915, better directional coverage can be obtained on any given floor. Rather than using omni-directional antennas, as described in the background section, unidirectional and bi-directional antennas provide better coverage, as well as an antenna platform on which a more efficient antenna array can be based. For example, in building 905, four or more omni-directional antennas would have to be used to cover the same space as that covered by the bi-directional antennas of concealed antenna assemblies 910 and 915.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An indoor RF network located within a building including at least one concealed antenna assembly comprising:

a base;

a sign having two planar pieces of substantially the same shape and size disposed substantially parallel to each other, the two planar pieces disposed substantially perpendicular to the base, the two planar pieces each having a front and back face; and an antenna concealed between the two planar pieces, the antenna having a front and back face and a radio frequency connection point, wherein the concealed antenna assembly provides communications to at least one wireless device located within the building.

2. The assembly of claim 1, further comprising:

a light source for illuminating the sign.

3. The assembly of claim 1, wherein the base is aligned with and attached to a ceiling.

4. The assembly of claim 1, wherein the antenna is a directional patch antenna.

5. The assembly of claim 1, wherein at least one of the two planar pieces is not optically opaque.

6. The assembly of claim 5, wherein the front or back face of the antenna has lettering visible through at least one of the planar pieces.

7. The assembly of claim 1, wherein the two planar pieces are opaque and have lettering thereby concealing the antenna.

8. An indoor RF network located within a building including at least one concealed antenna assembly comprising:

a base;

a planar sign having front and back face and an interior surface, the sign disposed substantially perpendicular to the base, the interior surface defining a channel extending within the sign; and an antenna concealed in the channel, the antenna having a front and back face and a radio frequency connection point, wherein the concealed antenna assembly provides communications to at least one wireless device located within the building.

9. The assembly of claim 8, further comprising:

a light source for illuminating the sign.

10. The assembly of claim 8, wherein the base is aligned with and attached to a ceiling.

11. The assembly of claim 8, wherein the antenna is a directional patch antenna.

12. The assembly of claim 8, wherein the front or back face of the sign is not optically opaque.

13. The assembly of claim 12, wherein the front or back face of the antenna has lettering visible through the front or back face of the sign.

14. The assembly of claim 8, wherein the front and back face of the sign are opaque and have lettering thereby concealing the antenna.

15. An indoor RF network located within a building including at least one concealed antenna assembly comprising:

a base;

a planar sign having a front and back face, the planar sign disposed substantially perpendicular to the base; and an antenna having a front and back face and a radio frequency connection point, the antenna concealed by the front face of the sign such that the front face of the antenna is adjacent to the back face of the sign, wherein the concealed antenna assembly provides communications to at least one wireless device located within the building.

16. The assembly of claim 15, further comprising:

a light source for illuminating the sign.

17. The assembly of claim 15, wherein the base is aligned with and attached to a ceiling.

18. The assembly of claim 15, wherein the antenna is a directional patch antenna.

19. The assembly of claim 15, wherein the antenna is not optically opaque.

20. The assembly of claim 15, wherein the planar sign is not optically opaque and the antenna has lettering on its front or back face.

* * * * *